United States Patent [19]

Willems et al.

[11] 4,004,926

[45] Jan. 25, 1977

[54] FORMATION OF AZINE DYES

[75] Inventors: Jozef Frans Willems, Wilrijk; Wilhelmus Janssens, Aarschot, both of Belgium

[73] Assignee: AGFA-GEVAERT N.V., Mortsel, Belgium

[22] Filed: Mar. 26, 1975

[21] Appl. No.: 562,114

[30] Foreign Application Priority Data

Apr. 2, 1974 United Kingdom ..... 14542/74

[52] U.S. Cl. ..... 96/66 R; 96/9; 96/22; 96/55

[51] Int. Cl.[2] ..... G03C 5/30; G03C 7/04; G03C 7/16; G03C 7/00

[58] Field of Search ..... 96/66 R, 55, 109, 9, 96/22

[56] References Cited

UNITED STATES PATENTS

| | | | |
|---|---|---|---|
| 3,245,787 | 4/1966 | Willems et al. | 96/9 |
| 3,265,502 | 8/1966 | Willems et al. | 96/66 R |
| 3,447,923 | 6/1969 | Jaeken | 96/55 |

*Primary Examiner*—David Klein
*Assistant Examiner*—L. X. Falasco
*Attorney, Agent, or Firm*—William J. Daniel

[57] ABSTRACT

A method of producing a colored image by developing a latent silver image obtained by the image-wise photo-exposure of a photosensitive silver halide material, wherein the development is carried out with p-phenylenediamine corresponding to the following general formula:

wherein:

each of $R'_1$, $R'_2$, $R'_3$, and $R'_4$ (same or different) represents an alkyl group, in the presence of 1. a hydrazone compound having the following general formula:

wherein:

$n$ is 1, 2, or 3, $R_1$ is hydrogen or an acyl group, and $R_2$ is a $—CONH_2$ group or a $—SO_2X$ group, wherein X represents a hydroxyl group, an amino group, an aliphatic group, an aryl group or an heterocyclic group, $R_3$ is an alkyl group or an aryl group, and Z represents the necessary atoms to close a nitrogen-containing heterocyclic nucleus, and 2. a color coupler of the phenol, naphthol, or active methylene compound series.

10 Claims, 1 Drawing Figure

FORMATION OF AZINE DYES

Figure 1:
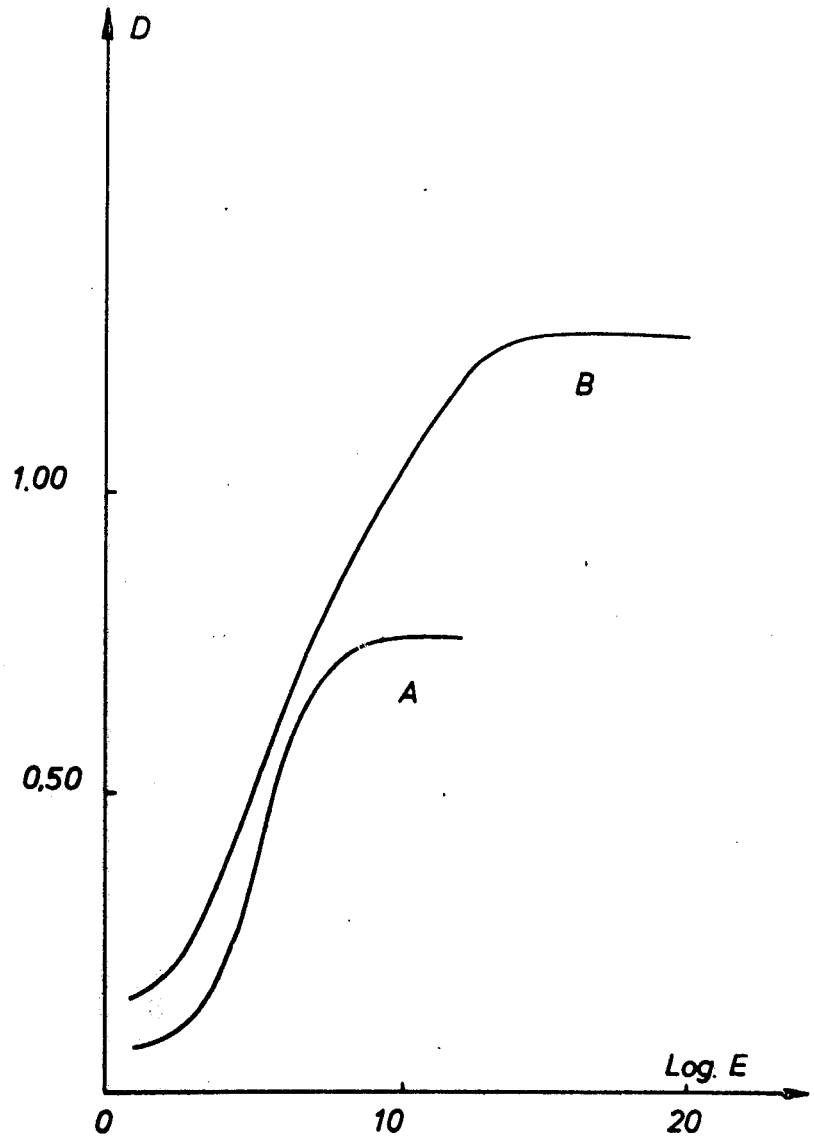

This invention relates to colour photography and more particularly to a colour development process.

As is known, the property of certain organic compounds to form a dye during the development of photo-exposed silver halide by coupling with a proper oxidized developing substance is the basis for the classical photographic dye image formation.

According to the classical technique quinonimine dyes and azomethine dyes are formed by coupling of the usual colourless couplers of the phenol, naphthol, or ketomethylene type with an oxidized aromatic amino developing substance e.g. a primary amino p-phenylenediamine derivative.

It is known that azomethine dyes are not particularly stable and therefore other photographic dye-forming systems for producing dye images with improved stability have been proposed.

Thus, e.g. in the U.S. Pat. No. 3,447,923 a colour photographic process has been described wherein azine dyes having a greater stability than azomethine dyes are produced by colour developing a bleached silver image still containing silver nuclei. The colour development is carried out by oxidatively coupling a colour coupler with a hydrazone compound, dissolved in an aqueous alkaline medium, said hydrazone compound containing the following structural part:

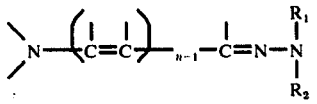

wherein:

$n$ is a positive integer from 1 to 3, $R_1$ is hydrogen or an acyl group, and $R_2$ is a $—CONH_2$ or a $—SO_2X$ group, wherein X represents a hydroxyl group or an amino group, an aliphatic hydrocarbon group, an aryl group, or a heterocyclic group including said groups in substituted form.

Said colour-forming process requires in addition to a silver image development step a bleaching step that has to be controlled rather carefully in order to obtain a bleached silver image still containing silver nuclei.

It has now been found a colour photographic process according to which particularly stable azine dyes can be formed already in the colour development of a latent silver image that is obtained by the image-wise photo-exposure of a photo-sensitive silver halide material. According to the present invention the development of the latent silver image is carried out with a p-phenylenediamine as defined hereinafter in the presence of 1. a hydrazone compound corresponding to the following general formula:

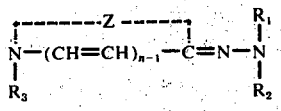

wherein:

$n$ is 1, 2, or 3, $R_1$ is hydrogen or an acyl group e.g. acetyl, $R_2$ is a $—CONH_2$ group or a $—SO_2X$ group, wherein X represents a hydroxyl group, an amino group, a hydrocarbon group, e.g. an alkyl group or an aryl group, or a heterocyclic group including said groups in substituted form, $R_3$ is an alkyl group or an aryl group e.g. a methyl group, and Z represents the necessary atoms to close a nitrogen-containing heterocyclic nucleus including said nucleus in substituted form e.g. substituted with alkyl or a sulpho group, and 2. a colour coupler of the phenol, naphthol, or active methylene compound series e.g. a non-ring closed ketomethylene type coupler.

In the classical colour development process said couplers yield indophenol (quinonimine) and azomethine dyes respectively.

The p-phenylenediamines suited for use according to the present invention correspond to the following general formula:

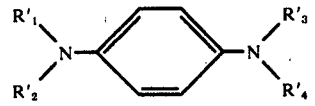

wherein:

each of $R'_1$, $R'_2$, $R'_3$, and $R'_4$ (same or different) represents an alkyl group or substituted alkyl group, preferably a lower ($C_1$–$C_5$) alkyl group or $R'_1$ and $R'_2$, or $R'_3$ and $R'_4$ represent the necessary atoms to close a 5- or 6-membered heterocyclic nitrogen-containing ring e.g. pyrrolidine ring or $R'_1$ and/or $R'_2$ and/or $R'_3$ and/or $R'_4$ represent the necessary atoms to close via the ortho-carbon atom of the benzene ring a 5- or 6-membered nitrogen-containing adjacent heterocyclic nucleus.

To improve the solubility of said p-phenylene diamine it can be substituted e.g. on one or more of the alkyl groups with e.g. a carboxylic acid or sulphonic acid group.

Compounds within the scope of the above general formula are described e.g. in the U.S. Pat. 3,265,502 and in the U.K. Pat. Specification 1,191,535.

Particularly good results are obtained with a tetraalkyl-p-phenylenediamine which has the following structural formula:

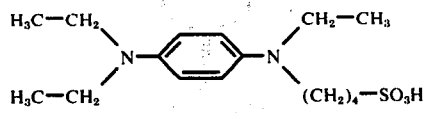

and which was prepared as follows:

38.5 g of triethylphenylenediamine and 27.2 g of 1-butanesulphonic acid, 4-hydroxy-, sultone were melted together for 5 hours at 100° C. The resulting reaction mixture was dissolved in water. The aqueous solution obtained was extracted with diethyl ethyl to remove unreacted starting material. To the thus treated aqueous solution 100 ml of aqueous concentrated hydrochloric acid were added and the mixture was subjected to evaporation under reduced pressure. The residue left was put into 700 ml of anhydrous ethanol and boiled. The solution was cooled and the precipitate was sucked off and dried. Yield: 56 g. Melting point: 210° C.

The p-phenylenediamine developing agent is incorporated into an aqueous alkaline solution, the pH of which is preferably between 8 11. The developing bath contains e.g. from 1 to 10 g of developing agent per litre. The developing bath may further contain the usual ingredients present in colour developing baths e.g. potassium bromide.

Hydrazone compounds that are particularly suitable for use according to the present invention correspond to one of the following general formulae:

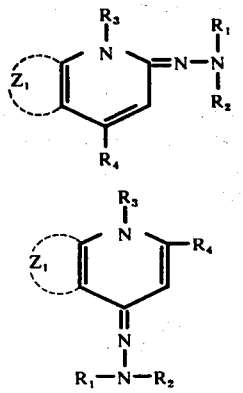

wherein:

$R_1$ is hydrogen or an acyl group e.g. acetyl, $R_2$ is a $-CONH_2$ group or a $—SO_2X$ group, wherein X represents a hydroxyl group, an amino group, an aliphatic hydrocarbon group, an aryl group, or a heterocyclic group including said groups in substituted form e.g. substituted with carboxyl or sulpho, $R_3$ is an alkyl group e.g. methyl or an aryl group e.g. phenyl, $R_4$ is an alkyl group e.g. $C_1$ –$C_{18}$ alkyl or an aryl group e.g. phenyl and $Z_1$ represents the atoms necessary to complete a benzene nucleus including a substituted and further condensed benzene nucleus.

The preparation of hydrazone compounds suited for use according to the present invention is described e.g. in the U.S. Pat. No. 3,245,787 –3,293,032 –3,525,614 and 3,622,327 and in the U.K. Pat. specification 993,749 and in the German Pat. application P 22 14 381.

Preferred hydrazone compounds are listed in Table 1.

Table 1

1.

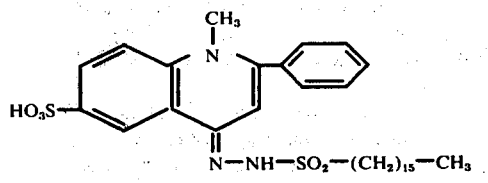

2.

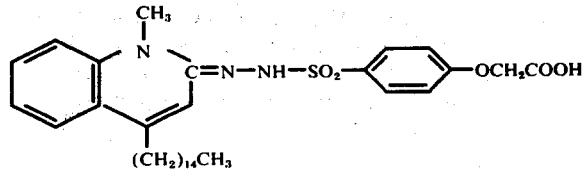

Colour couplers that are particularly suitable for use according to the present invention are phenol couplers corresponding to the following general formula:

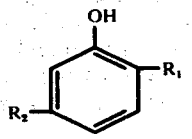

wherein:

each of $R_1$ and $R_2$represents hydrogen, an alkyl group including a substituted alkyl group, an alkoxy group including a substituted alkoxy group, or the group -NHR in which R represents a carboxylic acid acyl or sulphonic acid acyl group including said groups in substituted state, e.g. an aliphatic carboxylic acid acyl group, an aromatic carboxylic acid acyl group, an heterocyclic carboxylic acid acyl group e.g. a 2-furoyl group or a 2-thienoyl group, an aliphatic sulphonic acid acyl group, an aromatic sulphonic acid acyl group, a sulphonyl thienyl group, an aryloxy-substituted aliphatic carboxylic acid acyl group, a phenylcarbamyl aliphatic carboxylic acid acyl group or a tolyl carboxylic acid acyl group, with the proviso that $R_1$ and $R_2$ do not represent hydrogen at the same time.

For such type of phenol colour couplers and their preparation reference is made to U.S. Pat. 2,772,162 and 3,222,176, and the U.K. Pat. specification 975,773.

Representatives being within the scope of that general formula are listed in Table 2.

Table 2
1.
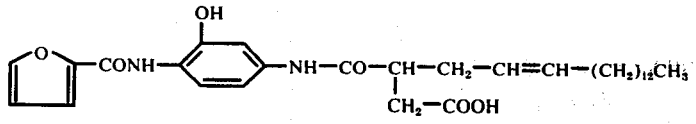
2.
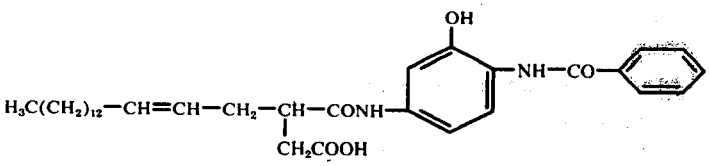
3.
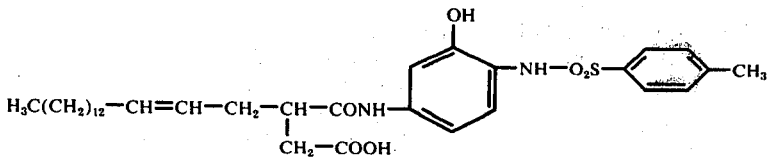
4.
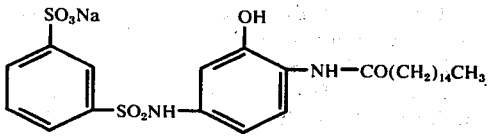
5.
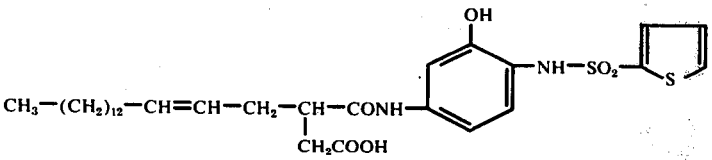
6.
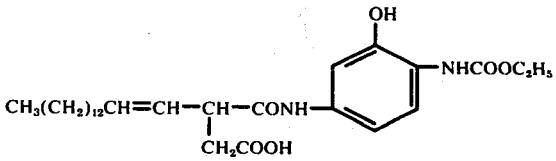
7.
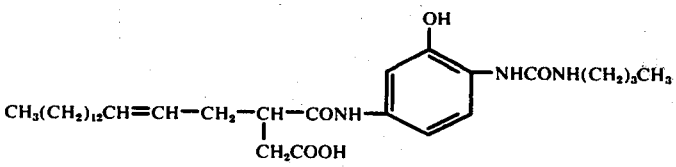
8.
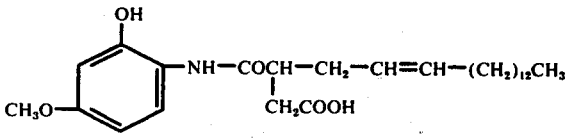
9.
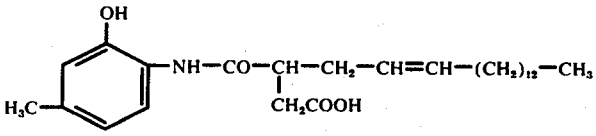
10.
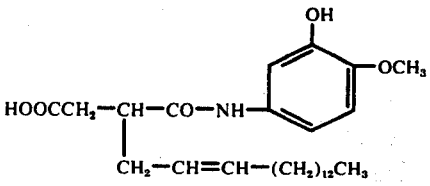

-continued

Table 2

11.

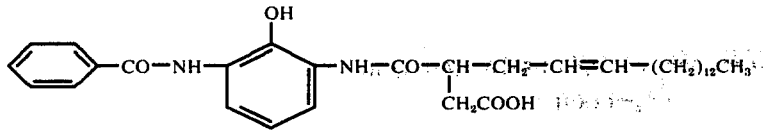

12.

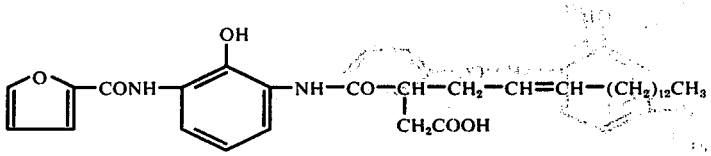

Useful couplers of the naphthol series are α-naphthol type couplers corresponding to the following general formula:

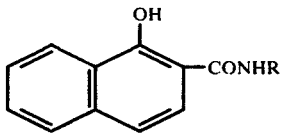

wherein:

R represents an alkyl group including a substituted alkyl group, an aryl group including a substituted aryl group preferably such groups that are substituted with a carboxylic acid or sulphonic acid group.

These α-naphthol type couplers are prepared, e.g., by a condensation reaction applying the phenyl ester of 1-hydroxy-2-naphthoic acid and the proper amine.

Examples of said α-naphthol couplers are listed in the following Table 3.

Table 3

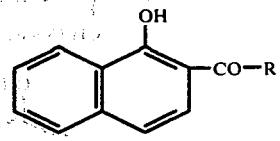

R :

1.

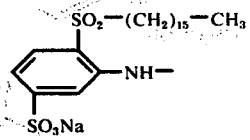

2.

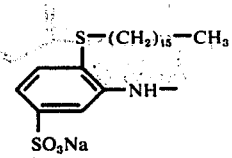

3.

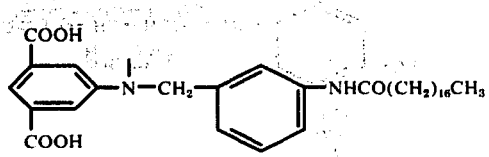

4.

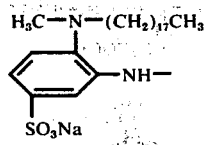

5.

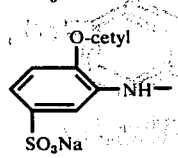

Table 3

-continued

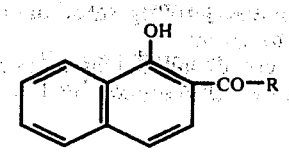

R :

6. 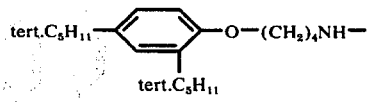

Non-ring closed ketomethylene type couplers suited for use according to the present invention are the colour couplers forming a yellow azomethine dye with an oxidized primary amino p-phenylenediamine. Such couplers are described e.g. by P. Glafkides in "Photographic Chemistry," Vol. II (1960) p. 597–602 under the heading "yellow couplers" and in the United Kingdom Pat. specification 1,039,965 –1,075,084 and 1,062,203.

A particularly useful non-ring closed ketomethylene type coupler corresponds to the following structural formula:

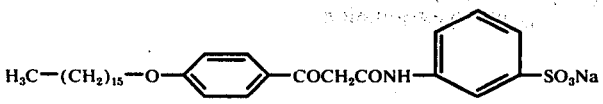

The above colour couplers and hydrazone compounds may be incorporated in a silver halide emulsion layer without fogging the latter. Preferably said couplers and hydrazone compounds contain in their structure a so-called "ballasting group"making these compounds resistant to diffusion in hydrophilic photographic colloid layers. Such a group is preferably an aliphatic group containing at least 5 and preferably from 5 to 20 carbon atoms in an unbranched chain. Such a balasting group is e.g. a $C_5$-$C_{20}$ alkyl group. An ionic group such as a carboxylic acid or sulpho group is preferably present for incorporating the couplers in dissolved form in an alkaline medium in the photographic emulsion.

The colour couplers and hydrazones used according to the present invention may be added to the light-sensitive silver halide composition in dissolved or finely dispersed state either or not with the aid of high-boiling solvents. Suitable techniques for the incorporation of photographic ingredients into colloid compositions are described e.g. in the published Dutch Patent Applications 675,529 –675,531 675,532 –675,530 and 675,528 and in the Belgian Patent Specification 705,889.

The amount of hydrazone and colour coupler in the silver halide material is not critical. Preferably, however, the colour coupler, the hydrazone and the silver halide are present in a ratio of 1 mole of colour coupler for at least one equivalent of hydrazone and at least 4 moles of silver halide.

According to a preferred embodiment the colour couplers are present in the silver halide emulsion layer in non-migratory form.

Thus, it is possible to obtain a colour reproduction in complementary colours of a coloured original by using a multilayer photographic colour material, which contains a red-sensitive silver halide emulsion layer, a green-sensitive silver halide emulsion layer, and a blue-sensitive silver halide emulsion layer, the red-sensitive emulsion layer containing in non-migratory form a colour coupler capable of forming a cyan dye on development with a hydrazone compound of the type cited above, the gree-sensitive emulsion layer containing in non-migratory form a colour coupler capable of forming on development a magenta dye with a hydrazone compound, the only blue-sensitive emulsion layer containing in non-migratory form a colour coupler capable of forming a yellow dye with a hydrazone compound.

In the multilayer photographic colour material a yellow filter layer may be present between the blue-sensitive emulsion layer and the green- or red-sensitive emulsion layer.

According to a special embodiment the hydrazone compound and colour coupler are united in one compound $C_1$–$C_2$ in which the $C_1$ part is the colour coupler part and the $C_2$ part is the hydrazone part. When using such compound an "intramolecular" oxidative coupling takes place in the developing conditions of the present invention.

Intramolecular oxidative coupling means that the reactive $C_1$ and $C_2$ parts of the same $C_1$–$C_2$ molecule are oxidatively coupled and form a dye molecule.

In particularly suited $C_1$–$C_2$ compounds described in the published German Pat. application P 22 14 381 the part $C_1$ is a group containing the structure of an α-naphthol coupler and corresponds to the following general formula:

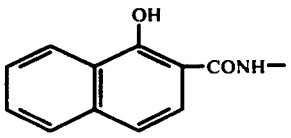

The $C_2$ part corresponds preferably to the following general structure:

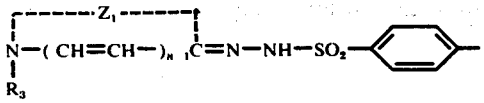

wherein:

$R_3$ represents an alkyl group or an aryl group, n is 1 or 2, and $Z_1$ represents the necessary atoms to close a heterocyclic nitrogen-containing nucleus including said nucleus in substituted form, e.g. substituted with an alkyl and a sulpho group.

A preferred $C_1$–$C_2$ compound that produces an azino dyestuff by oxidative intramolecular coupling has the following formula:

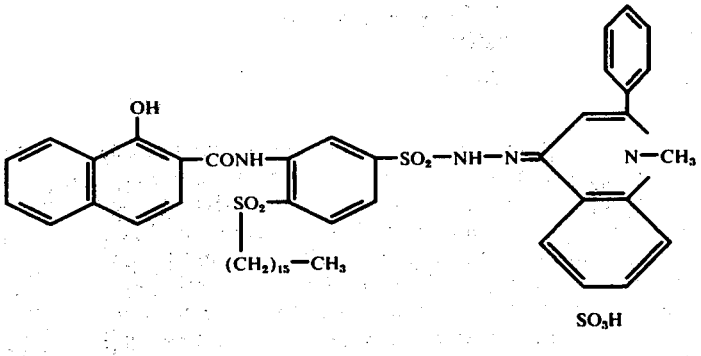

(melting point: 140° C).

The reaction for forming the azine dyes according to the present invention has been studied and we assume that the following reaction scheme is representative for the azine dye formation:

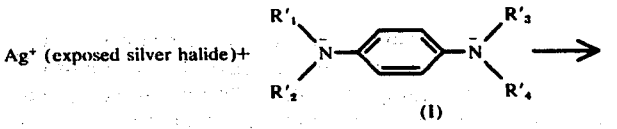

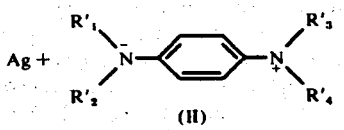

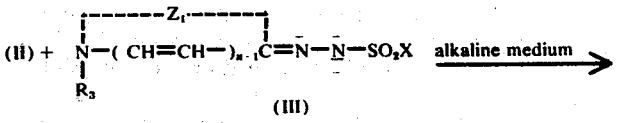

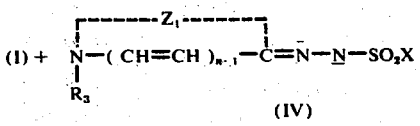

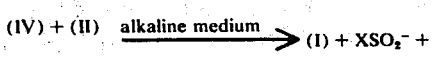

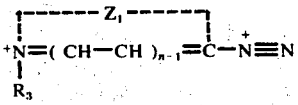

(V) (diazonium salt)

-continued

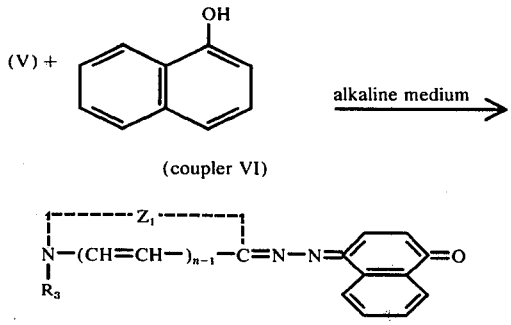

(VII) (azine dye)

The hydrazone compounds and colour couplers may be combined with each other in such a way that together with the silver image cyan, magenta, or yellow colour images are produced.

Normally the colour development of the present invention is applied for the production of negative images i.e. images corresponding with the photo-exposed area of the recording material. The colour development may likewise be applied for the production of positive images e.g. by using a known direct-positive material or a reversal processing.

A reversal colour image may be produced by the steps of (i) developing the exposed areas of a silver halide emulsion layer with a non-coupling black-and-white developer, e.g. hydroquinone, (ii) fogging unexposed silver halide left, and (iii) developing the latter with the N,N,N',N'-tetraalkyl-p-phenylenediamine developer in the presence of at least one of said couplers and hydrazone compounds.

A particularly interesting feature of the present invention is the possibility to economize on silver by selecting the dye production in such a way that in addition to the black silver image a blue or gray dye image is produced in the silver halide emulsion layer.

So, the total optical density is increased so that with a smaller amount of silver halide an image with acceptable density and gradation is obtained.

An economy on silver is of particular interest in the manufacture of X-ray emulsions, having a rather high silver halide content.

The following examples illustrate the present invention without, however, limiting it thereto.

EXAMPLE 1

2.9 g of naphthol colour coupler 3 of Table 3 were dissolved in 140 ml of water and 10 ml of aqueous 1N sodium hydroxide. The solution obtained was added to 142 ml of a 10% by weight aqueous gelatin solution containing a common wetting agent for photographic materials.

2.5 g of hydrazone compound 1 of Table 1 were dissolved in 100 ml of water in which previously 1 g of potassium hydroxide had been dissolved. The solution obtained was added to the gelatin solution containing the colour coupler at a pH lower than 6.5. Acetic acid was used to keep the pH below this level.

To the gelatin solution containing both the coupler and hydrazone compound 65 g of a fine grain silver chloride gelatin emulsion were added. (The emulsion contained an amount of silver chloride equivalent to 60 g of silver nitrate per liter).

A usual chrome alum hardening agent was added to the emulsion and the pH of the latter was adjusted to 5.7.

The emulsion was coated on a transparent cellulose triacetate support at a coverage of 125 g per sq.m and dried.

A same photographic material (called the blank) was prepared with the proviso, however, that the hydrazone compound was omitted from the composition.

The blank material was exposed through a step wedge and developed with a developing liquid having the following composition:

| | |
|---|---|
| sodium carbonate | 50 g |
| potassium bromide | 1 g |
| a common primary amino-p-phenylenediamine developer having the following structural formula : 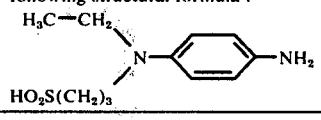 | 5 g |

A cyan wedge print composed of a quinonimine dye was obtained after usual bleaching, fixing, and rinsing.

In combination with the photographic material containing the hydrazone compound and napthol coupler a developing bath was applied containing instead of said primary amino p-phenylendiamine developer 5 g of a tetra-alkyl-p-phenylenediamine having the following structure formula:

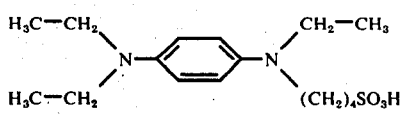

The obtained wedge print contained a cyan azino dye that through thin layer chromatography was identified with the following structure:

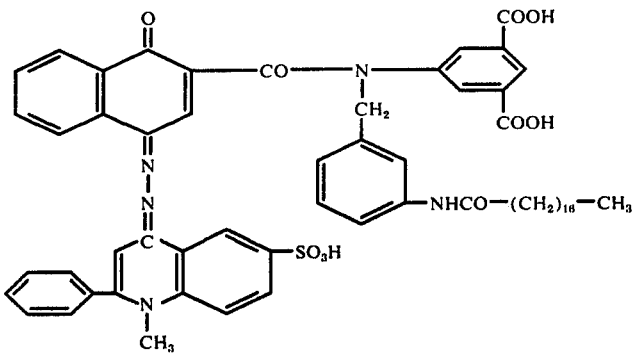

The sensitometric curves (density D versus log exposure (log E) measured with red light) are given in FIG. 1. Curve A represents the result obtained with the quinonimine dye process, curve B represents the result obtained with the process of the present invention producing an azine dye.

From these curves it can be learned that with said photographic azine dye formation a higher density, higher sensitivity, and larger exposure latitude are obtained than with said quinonimine dye formation.

The application of the tetra-alkyl-p-phenylene developer and combination of said hydrazone and coupler in the colour reversal process yielded a positive azine dye wedge print showing the same advantages as obtained in the above described "negative" process.

EXAMPLE 2

2.3 g of a non-ring closed ketomethylene type coupler having the following structural formula:

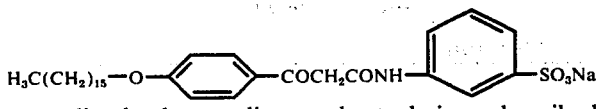

were dissolved according to the technique described for the naphthol coupler of Example 1. The solution obtained was combined with the same hydrazone and silver chloride emulsion of Example 1. The resulting light-sensitive silver halide colour emulsion was coated on a cellulose triacetate base in a ratio of 125 g per sq.m.

A blank material was prepared as described in Example 1. The blank material and the material containing the hydrazone and ketomethylene coupler were exposed in the same way through a step wedge and processed (developed) with the primary amino p-phenylenediamine developer and tetra-alkyl p-phenylendiamine developer respectively of Example 1.

The development with the first mentioned developer yielded a yellow azomethine dye, the development with the second developer yielded a more stable yellow azine dye having the following structure:

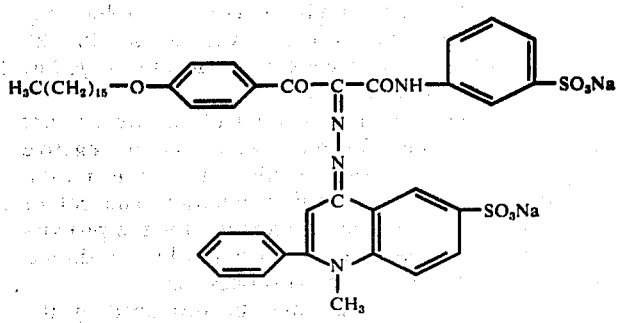

EXAMPLE 3

2.6 g of naphthol colour coupler 1 of Table 3 were dissolved in 140 ml of water and 10 ml of aqueous 1N sodium hydroxide. The solution obtained was added to 142 ml of a 10% by weight aqueous gelatin solution containing a common wetting agent for photographic materials.

2.4 g of hydrazone compound 2 of table 1 were dissolved in 100 ml of water, in which previously 1 g of potassium hydroxide had been dissolved. The solution obtained was added to the gelatin solution containing the colour coupler at a pH lower than 6.5. Acetic acid was used to keep the pH below this level of 6.5.

To the gelatin solution containing both the coupler and the hydrazone compound 65 g of a fine grain silver chloride gelatin emulsion was added. (The emulsion contained an amount of silver chloride equivalent to 60 g of silver nitrate per liter). After the addition of chrome alum as hardening agent, the emulsion was coated on a transparent cellulose triacetate support in a ratio of 125 g per sq.m.

A blank material was prepared as described in Example 1. The blank material and the material containing the hydrazone and naphthol coupler were exposed in the same way through a step wedge and processed (developed) respectively with the primary amino p-phenylenediamine developer and tetra-alkyl p-phenylenediamine developer of Example 1.

The development with the first mentioned developer yielded a quinone-imine dye, the development with the second developer yielded a more stable magenta azine dye having the following structure:

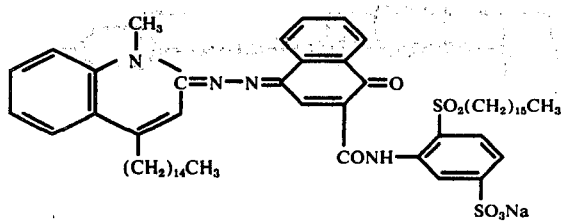

We claim:

1. A method of producing a coloured image by developing a latent silver image obtained by the image-wise photo-exposure of a photosensitive silver halide material, wherein the development is carried out with p-phenylenediamine corresponding to the following general formula:

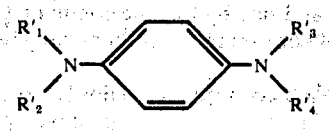

wherein:

each of $R'_1$, $R'_2$, $R'_3$, and $R'_4$ (same or different) represents an alkyl group, in the presence of 1. a hydrazone compound having the following general formula:

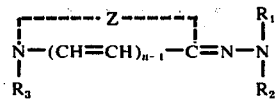

wherein:

$n$ is 1, 2, or 3, $R_1$ is hydrogen or an acyl group, and $R_2$ is a $—CONH_2$ group or a $—SO_2H$ group, wherein X represents a hydroxyl group, an amino group, an aliphatic group, an aryl group or an heterocyclic group, $R_3$ is an alkyl group or an aryl group, and Z represents the necessary atoms to close a nitrogen-containing heterocyclic nucleus, and 2. a colour of the phenol, naphthol, or active methylene compound series.

2. A method according to claim 1, wherein the p-phenylenediamine has the following formula:

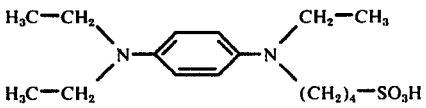

3. A method according to claim 1, wherein the hydrazone compound corresponds to one of the following general formulae:

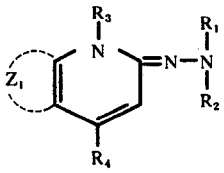

-continued

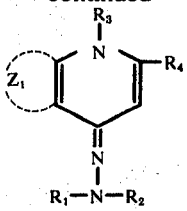

wherein:

$R_1$ is hydrogen or an acyl group, $R_2$ is a $—CONH_2$ group or a $—SO_2X$ group, wherein X represents a hydroxyl group, an amino group, an aliphatic hydrocarbon group, an aryl group or a heterocyclic group, $R_3$ is an alkyl group or an aryl group, $R_4$ is an alkyl group or an aryl group, and $Z_1$ represents the atoms necessary to complete a benzene nucleus.

4. A method according to claim 1, wherein the hydrazone compound is one of the following:

1.

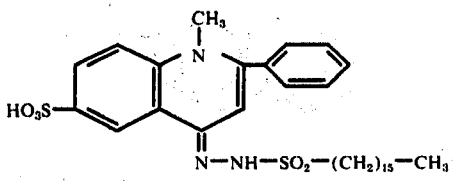

2.

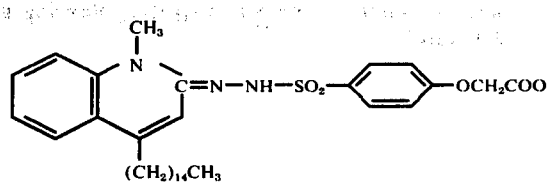

5. A method according to claim 1, wherein the colour coupler is a phenol type coupler, which corresponds to the following general formula:

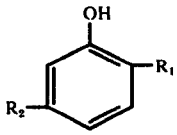

wherein:

each of $R_1$ and $R_2$ represents hydrogen, an alkyl group, an alkoxy group, or the group —NHR, in which R represents a carboxylic acid acyl or sulphonic acid acyl group, with the proviso that $R_1$ and $R_2$ do not represent hydrogen at the same time.

6. A method according to claim 1, wherein the colour coupler is an $\alpha$-naphthol type coupler, which corresponds to the following general formula:

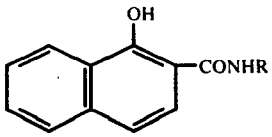

wherein:

R represents an alkyl group, an aryl group.

7. A method according to claim 1, wherein the colour coupler is a non-ring closed ketomethylene type coupler corresponding to the following structural formula:

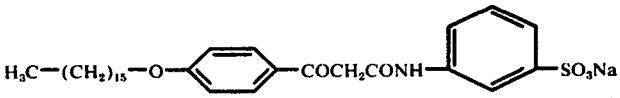

8. A method according to claim 1, wherein the hydrazone and colour coupler are chemically united in a compound of the general structure $C_1$–$C_2$ that is capable of oxidatively intramolecularly coupling, and wherein the $C_1$ moiety is a group containing the structure of an $\alpha$-naphthol coupler corresponding to the formula:

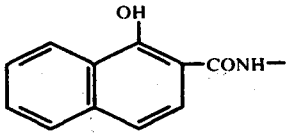

and and $C_2$ moiety corresponds to the following general structure:

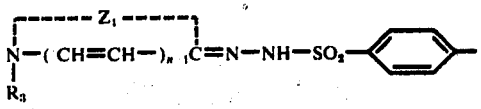

wherein:

$R_3$ represents an alkyl group or an aryl group, $n$ is 1 or 2, and $Z_1$ represents the necessary atoms to close a heterocyclic nitrogen-containing nucleus.

9. A method according to claim 1, wherein said colour coupler and said hydrazone compound are present in the silver halide emulsion layer already before development.

10. A method according to claim 1, with the modification that the latent silver image developed with the p-phenylenediamine is obtained by a reversal processing comprising the steps of (i) developing the exposed areas of the silver halide material with a non-coupling black-and-white developer, (ii) fogging unexposed silver halide left, and (iii) developing the fogged silver halide with said p-phenylenediamine in the presence of said hydrazone and said colour coupler.

* * * * *

UNITED STATES PATENT AND TRADEMARK OFFICE

CERTIFICATE OF CORRECTION

PATENT NO. : 4,004,926

DATED : January 25, 1977

INVENTOR(S) : Jozef Frans Willems et al

It is certified that error appears in the above-identified patent and that said Letters Patent are hereby corrected as shown below:

Claim 1, second to last line, after "colour" the word -- coupling -- should be inserted.

Claim 4, please supply the missing hydrogen atom on the carboxyl group in the right end of the second formula.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*